United States Patent [19]

Short

[11] 4,150,596

[45] Apr. 24, 1979

[54] HYDRAULIC HOLD-DOWN CIRCUIT

[75] Inventor: Wilbur G. Short, Browns, Ill.

[73] Assignee: Canron, Inc., Oakland, Calif.

[21] Appl. No.: 776,636

[22] Filed: Mar. 11, 1977

[51] Int. Cl.[2] ..... B26D 5/42

[52] U.S. Cl. ..... 83/380; 83/385

[58] Field of Search ..... 83/380, 375, 378, 385

[56] References Cited

U.S. PATENT DOCUMENTS

| | | | |
|---|---|---|---|
| 2,699,649 | 1/1955 | Messick | 83/380 X |
| 3,026,755 | 3/1962 | Castle, Jr. | 83/380 |
| 3,908,496 | 9/1975 | Moelbert | 83/378 X |

FOREIGN PATENT DOCUMENTS

| | | | |
|---|---|---|---|
| 965824 | 8/1964 | United Kingdom | 83/380 |

*Primary Examiner*—Willie G. Abercrombie

[57] ABSTRACT

On a shear machine having a ram, a work table, and a hold-down means to grip work to the work table, a hydraulically sequenced circuit to inhibit the down-stroke of the ram until a sufficient hold-down pressure has been achieved at the hold-down means to effectively grip the work to be operated upon, and a booster cylinder responsive to the down-stroke of the ram for maintaining the pressure at the hold-down means during the cutting stroke of the ram.

11 Claims, 5 Drawing Figures

HYDRAULIC HOLD-DOWN CIRCUIT

My invention relates to a shear machine or the like and in particular to a hydraulic circuit for a clamping means to prevent work from being pulled into the shearing knives or moved during a shearing operation and, to allow sequencing of the shearing operation only after such work is thoroughly secured to a work table.

Previous circuits used to build the gripping pressure and maintain the same throughout the shearing operation, required special pumps and/or accumulators along with many hydraulic valves.

Among the objects of my invention are:

(1) A novel and improved hydraulic hold-down circuit;

(2) A novel and improved hydraulic hold-down circuit that borrows initial power from the shear machine hydraulic source;

(3) A novel and improved hydraulic hold-down circuit that maintains constant hold-down pressure during the shearing position;

(4) A novel and improved hydraulic hold-down circuit that controls the sequencing of the shear machine;

(5) A novel and improved hydraulic hold-down circuit where hold-down pressure is easily varied.

Additional objects of my invention will be brought out in the following description of a preferred embodiment of the same taken in conjunction with the accompanying drawings, wherein.

Figure 1:
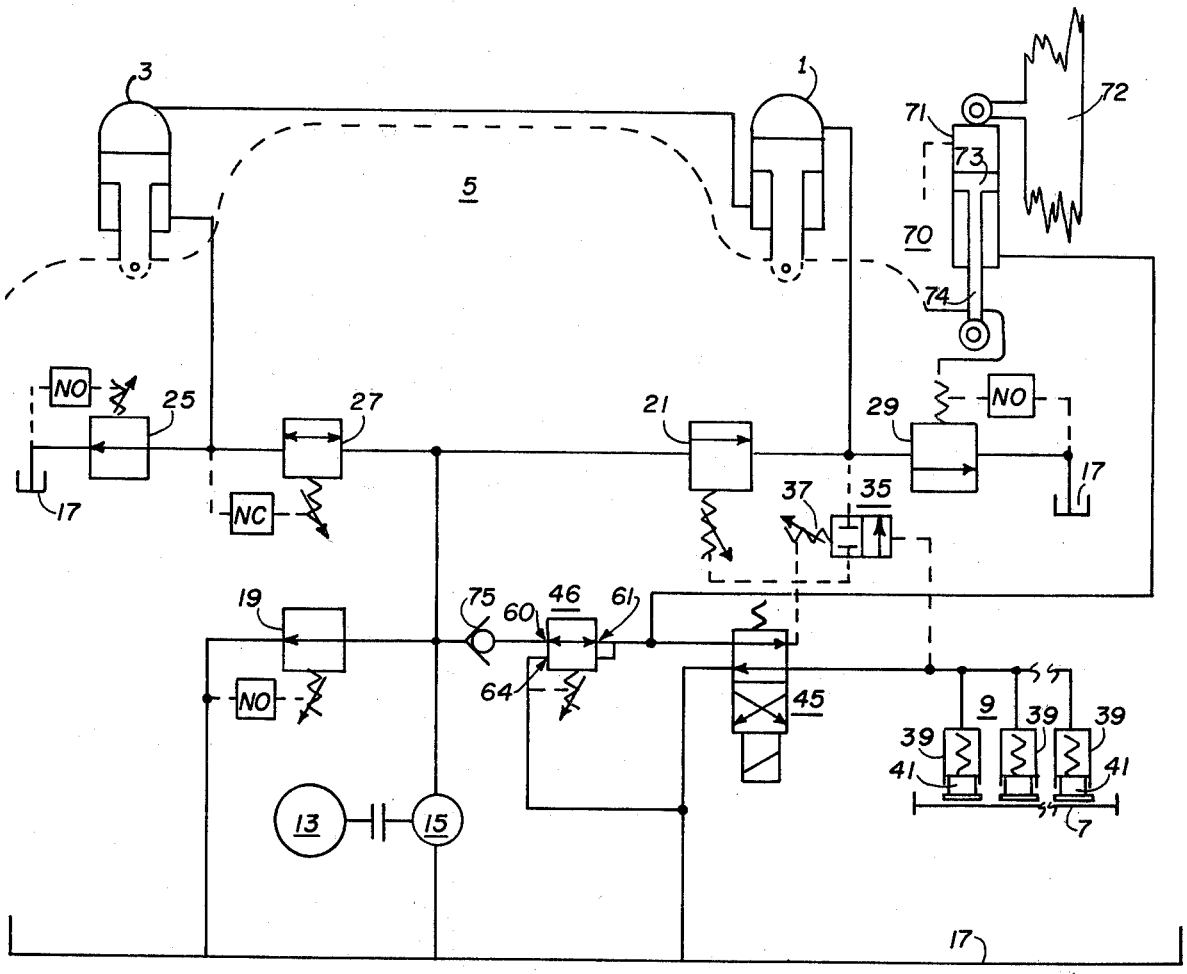
FIG. 1 is a hydraulic circuit depicting the features of the invention.

For details of my invention in its preferred form, reference will be had to the accompanying drawings wherein the invention is applied to a shear machine having a pair of drive piston assemblies 1, 3, a reciprocating ram 5 for performing an operation on work, a work-table 7 for supporting such work, a hold-down means 9 for holding such work to the work-table during the work operation, means for applying pressure to said hold-down means until a holding pressure level has been achieved, and means responsive to such ram movement during a work operation for supplying pressure to the hold-down means during the work-stroke.

In a cycled up idle shear machine, one wherein a motor/pump systm 13, 15 is operating while a shearing operation is not in progress, fluid is in idle circulation from a resevoir 17, through an electrically activated relief valve 19, and back to the resevoir. The relief valve 19, when not activated, imposes a low resistance to flow therethrough, and such idle circulation continues until a shearing operation is initiated by an operator.

At the initation of such shearing operation, the relief valve is electrically activated, and thereby closed, causing the same to function with relief characteristics, opening to flow only above a predefined pressure. This pressure now becomes the operating pressure of the system.

A activated "down" valve 21 then allows fluid to the top of the right drive piston assembly 1 which is connected hydraulically from its underside to the top portion of the left drive piston assembly 3 which in turn is connected from its underside to the resevoir 17 by way of a "foot" valve 25.

The piston assemblies are thus operated in series and so designed as to insure equal rate of travel of both pistons as they drive the ram in its cutting or downstroke.

An up-stroke is accomplished by directing fluid through a "two-up" valve 27 to the underside of the left piston assembly, and from the upper side of such assembly to the lower side of the right assembly and from the upper side of the right assembly through an operating "dump" valve 29 back to the resevoir.

A full description of all the above mentioned valves appears in my co-pending application for "Front Operated Rake Adjustment Assembly" No. 776,634.

"Down" valve 21 is a conventional valve having a pressure activated pilot means 35 normally biased to an off condition by an adjustable spring 37 causing the "down" valve to remain closed until pressure at the pilot becomes great enough to overcome spring bias.

In circuit with the "down" valve pilot is a conventional type hydraulic hold-down means 9, schematically illustrated in FIG. 1. Such hold-down means comprises a plurality of hydraulic cylinders 39, each having a spring biased footed piston 41 adapted to grip work to the work-table upon application of sufficient hydraulic pressure to overcome the bias.

Figure 2:
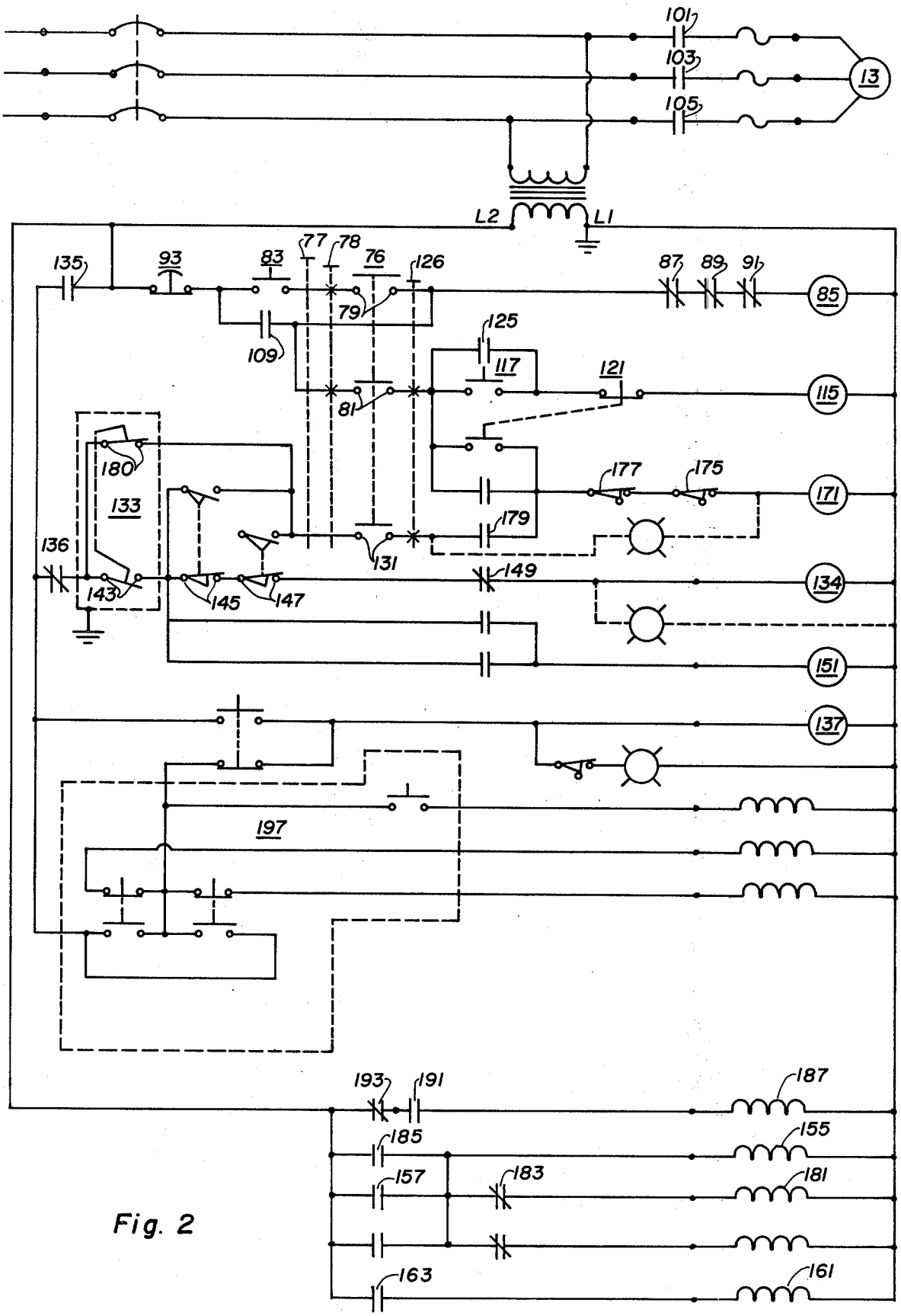
FIG. 2 is an electrical circuit for a shear machine including control features associated with the hydraulic circuitry of FIG. 1.

Application of hydraulic fluid to the hold-down means is controlled through a pilot operated "hold-down" valve 45 of a conventional type that responds to the electrical circuit depicted in FIG. 2.

With the shear machine in an idle condition prior to the initiation of shearing operation, pressure developed by hydraulic fluid as determined by the unactivated relief valve 19, is directed via a flow path through a reducing relief valve 46 and the "hold-down" valve 45 to reinforce the spring 37 biasing the "down" valve pilot in an off direction. The hold-down valve at this time also provides a flow passageway to vent the hold-down means back to the fluid resevoir.

Figure 3:
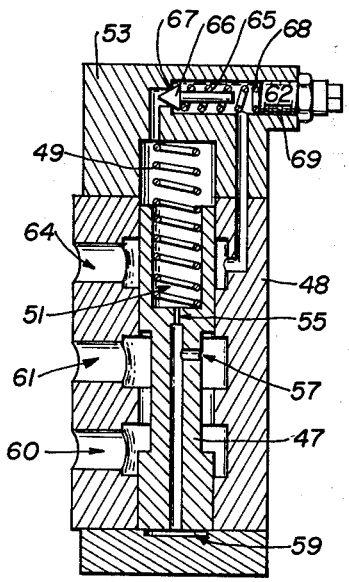
FIG. 3 is a view in section depicting a reducing relief valve in an inactive position.

The reducing relief valve 46 comprises a cylindrical spool 47 located within a cylindrical bore in the valve housing 48 which is normally in the inactive position shown in FIG. 3 when the shear machine is in an idle condition. The cylindrical spool is maintained in this inactive position by a biasing spring 49 housed in a recess 51 within the valve and bears against a head section 53 to create a chamber adjacent that end of the valve. An aixal passageway 54 through the spool, connects to the recess 51 through an orifice 55, and to a notched section of the spool through a lateral passage 57. The opposite end of the axial passageway connects to a chamber 59 in the base section.

The orifice 55 permits flow communication between the spring recess and the notched section of the spool which at this time is in flow connection with an input port 60, whereby, input pressure may accumulate in the spring recess and the adjacent chamber to assist the spring in maintaining the valve in its inactive position while the shear is at idle pressure. A reduced pressure regulated output port 61 is in flow communication with the input port 60 through the notched section of the spool, providing at this time equal input and ouput pressures at the valve.

The hold-down valve 45 is electrically activated at the initiation of a shearing operation in coincidence with the relief valve 19 which serves to increase system pressure. As a result of this activation, a flow passageway is created from the system pump 15 through the reducing relief valve 46 and "hold-down" valve 45 to the hold-down means 9, exposing such hold-down means to higher than idling pressures.

Figure 4:
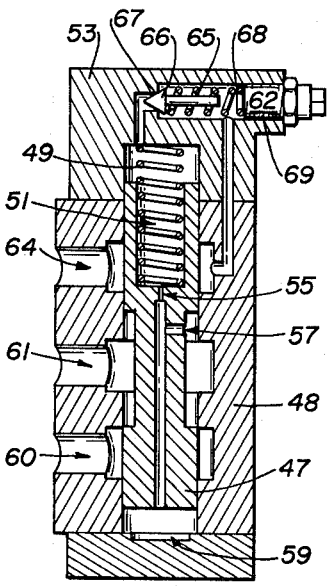
FIG. 4 is a view in section of the valve of FIG. 3 in a regulating position.

These higher pressures seen at the input port 60 act within the base section chamber 59 to provide a differential pressure bearing against that end of the spool in opposition to the pressure build-up in the spring recess 51, driving the spool away from its inactive position toward a pressure regulated position (FIG. 4).

The differential pressure inducing such spool movement is regulated by a pressure responsive valve assembly 62 installed in the valve head section 53 within a passageway from the head chamber to a fluid resevoir port 64. Such valve assembly includes a biasing spring 65 urging a conical valve 66 into a seat 67 within the passageway. Pressure at which the conical valve is unseated is dependent upon the pressure exerted by the biasing spring which is dependent upon the position within the passageway of a spring seat 68, the longitudinal position of which is adjustable through the intermediary of a threaded bolt 69, the end of which abuts the spring seat. This adjustability permits the setting of a minimum pressure at which to allow the opening of the valve, and thus the maximum pressure that may accumulate within the chamber.

With pressure high at the input port 60 and the spool blocking the input port opening, the reduced pressure regulated port alone is exposed to the base section chamber 59. Spool position at this time is controlled by the differential pressure between the reduced pressure regulated port 61 and by the pressure in the spool recess 51. A control pressure drop across the small orifice 55 will allow the spool to accurately regulate the pressure by modulating between the two ports, allowing fluid to pass from the input port into the reduced pressure regulated port as required.

As the gripping action commences, pressure building up behind the hold-down means increases until the maximum value has been achieved as determined by the reducing relief valve, and the pressure will be regulated at this level during the down stroke of the ram. Excess pressure appearing behind the hold-down means for any reason will drive the spool even further against the biasing spring until the pressure regulated port is exposed directly to the fluid resevoir port through the notched section of the spool.

The pressure for which the "down" valve pilot 35 is adjusted, is somewhat less than the reducing relief valve pressure, and is equal to that pressure which is considered adequate for firmly securing any piece of work to the work table by means of the hydraulic hold-down means, and thus when this pressure is achieved, it is sensed at the pilot via a flow connection to the hydraulic hold-down cylinders 39, and the pilot opens allowing the "down" valve to open and downward movement of the ram to commence.

It can thus be seen, how the work stroke of the ram is interlocked with the hydraulic hold-down means, and how insurance is given that the work is secured to the table prior to any downward movement of the ram.

A booster cylinder assembly 70, comprises a housing 71 fixed to a stationary part of the shear 72 and an enclosed piston 73 with a rod 74 fixed to the reciprocating ram 5, such that vertical up and down movement of the ram can be transferred directly to the piston.

The area under the piston is flow connected between the reducing relief valve 46 and the hold-down valve 45 such that any fluid under the piston is forced, during a ram down-stroke, into the hydraulic circuit providing fluid to the hold-down cylinders.

Figure 5:
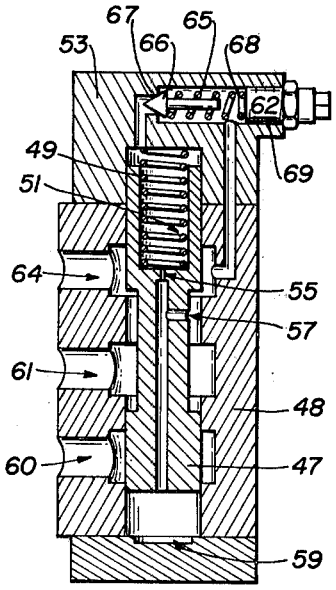
FIG. 5 is a view in section of the valve of FIG. 3 in a relieving position.

Pressure generated in the fluid by the piston during this down-stroke is sensed at the regulated port 61 of the reducing relief valve, and the spool within the valve takes the position as shown in FIG. 5, the higher pressures causing the spool to move to a position where the notched section exposes the pressure regulated port 61 to the resevoir port 64, allowing excess fluid supplied from the area beneath the piston of the booster cylinder assembly, to be relieved to the resevoir.

Pressure variations that may appear in the hydraulic hold-down circuit are isolated from the remainder of the shear hydraulic circuit at this time by means of a check valve 75 between the reducing relief valve and the rest of the circuit.

Thus, it becomes apparent how additional fluid supplied from the booster cylinder assembly into the regulated port, during the shear down-stroke, will maintain the set pressure at the regulated port, and therefore the gripping action of the hydraulic hold-down cylinders 39.

The "hold-down" valve is de-energized during an upstroke of the ram which moves the piston 73 back up into the booster cylinder, and hydraulic fluid at this time is pumped back into the housing under the piston in preparation for the next down-stroke.

Electrically, (FIG. 2), cycle up of the shear machine is accomplished by first turning the three position key-operated switch 76 from an off position 77 where no contacts are closed, to a first position 78, where the first and second sets of contacts 79, 81 are closed.

Depressing a "start" pushbutton 83 with the switch in the first position, completes a circuit from ground line L1 of a power source, through the motor starter 85 and overload contacts 87, 89, 91, the first set of contacts of the switch 79, and the normally closed contacts of an emergency stop pushbutton 93 to the power line L2 of the power source, thus activating the motor starter. The starter closes contacts 101, 103, 105 across a decreasing resistance in each of the three alternating current phases, bringing the motor 13 up to full speed.

Holding contacts 109 on the motor starter close when the starter is activated and complete a holding circuit around the start pushbutton 83 and the switch assembly 76. The motor starter holding contacts also complete a circuit through a power relay 115 upon depression of the button 117. This circuit is from the ground line L1, through the power relay, the normally closed contacts of the emergency return pushbutton 121, the pushbutton 117, contacts 81 of the switch assembly, holding contacts 109 of the motor starter, the emergency stop pushbutton 93 and back to power line L2.

Activating the power relay closes holding contacts 125 providing a holding circuit around the pushbutton 117 when the same is released. The shear machine at this stage is in a cycled up, idle condition.

At this time, with the motor starter holding circuit 109 bypassing the three position switch assembly 76, the assembly may be turned to its third position 126 where the second and third sets of contacts 81, 131 are closed.

A down or work stroke of the ram is initiated by depression of a foot switch 133 to a complete a circuit through a "down" relay 134 by way of the power source L2, now closed contacts 135 of power relay 115, normally closed contacts 136 of a backgauge adjustment relay 137, contacts 143 of the foot switch, contacts 145, 147 of a pair of depth limit switches located on either side of the ram, and normally closed contacts 149 of a single stroke relay 151 and to ground.

Activating the "down" relay 134, provides a circuit through the first relief valve solenoid 155 by way of a path from ground, through the now closed contacts 157 of the "down" relay and to the power source, and also completes a circuit to activate the hold-down valve solenoid 161 by providing a circuit through the solenoid from ground, through another set of now closed contacts 163 of the "down" relay and back to the power source.

It can be seen that the downward stroke will not physically start until the hold-down cylinders are gripping the work at the pressure set at the reducing relief valve as is necessary for maximum security, and once started will terminate when either one of the depth limit switches 145, 147 is opened to break the circuit through the "down" relay 134.

When the foot switch 133 is released, or at the termination of the down stroke, the ram is driven upwards by completion of a circuit through the "up" relay 171 from ground, a pair of now closed "open height" limit switches 175, 177, closed contacts 179 of the power relay, and now closed three position switch contacts 131, contacts 180 of the foot switch and back to the power source through closed contacts 135 and 136 of the power and backgauge adjustment relays respectively.

Activating the "up" relay provides a circuit from ground through the "two-up" solenoid 181, normally closed contacts 183 of the "down" relay, now closed contacts 185 of the "up" relay 171 and to the power source.

The "dump" valve pilot solenoid 187 is activated by a circuit from ground, through the pilot solenoid, now closed contacts 191 of the power relay, and normally closed contacts 193 of the "up" relay and to the power source.

Activation of the "two-up" and "dump" valves 27, 29 start the ram returning to its up position.

Shears of this type may have a back-gauging system of some nature and though an electrical circuit 197 for control of a back-gauging system is included in the drawings, it is not essential to an understanding of the current invention and therefore will not be further described.

From the foregoing description of my invention in its preferred form, it will be apparent that the same is subject to alternation and modification without departing from the underlying principals involved, and I accordingly do not desire to be limited in my protection to the specific details involved and described except as may be necessitated by the prior art.

I claim:

1. A shear machine comprising side walls, a reciprocating ram for performing an operation on work, a work table for supporting such work, a hold-down means for holding such work to said work table during such work operation, means applying pressure to said hold-down means and means responsive to ram movement during such work operation for supplying pressure to said hold-down means, said pressure supplying means comprising a housing with an included piston coupled between one of said side walls and said reciprocating ram with said housing flow connected to said hold-down means proximate one end thereof, whereby, pressure generated from within said housing is directed to said hold-down means.

2. A shear machine in accordance with claim 1, characterized by said housing being fixed to said side wall and said piston coupled to said ram and said housing containing hydraulic fluid, whereby, said fluid under pressure is directed to said hold-down means during a "down" stroke of said ram.

3. A shear machine in accordance with claim 1, characterized by said flow connection including a pressure limiting means whereby, the maximum pressure appearing at said hold-down means may be controlled.

4. A shear machine in accordance with claim 3, characterized by said pressure limiting means including an adjustable relief valve.

5. A shear machine comprising side walls, a reciprocating ram driven by hydraulic drive pistons for performing an operation on work, a work table for supporting such work, hold-down means for holding such work to said work table during such work operation, single hydraulic source means including hydraulic fluid in flow communication with said hold-down means and said reciprocating ram drive pistons and alternately operating said hold-down means and said reciprocating ram drive pistons, and means hydraulically isolating said hold-down means from said single hydraulic source means during hydraulic operation of said reciprocating ram such that during such operation all fluid from said source means is directed to said reciprocating ram drive pistons.

6. A shear machine in accordance with claim 5, characterized by booster means containing fluid coupled between said ram and one of said side walls for transferring reciprocating ram movement into hydraulic source means for maintaining pressure on said hold-down means during operation of said reciprocating ram drive pistons by said single source means.

7. A shear machine in accordance with claim 6, characterized by said means hydraulically isolating said hold-down means during operation of said reciprocating drive pistons comprising hydraulic circuitry flow connecting said single hydraulic source with said hold-down means, said hydraulic circuitry including pressure reducing means for reducing pressure in said hydraulic circuitry from that at said single hydraulic source means, said reducing means having an input port, a regulated output port, adjustment means for selecting pressure at said regulated output port and capability of inhibiting flow therethrough in response to pressure at said regulated port equaling or exceeding that selected by said adjustment means, and said booster means flow connected to said regulated port and operated by movement of said ram toward said work for supplying pressure at said regulated port equaling or exceeding that selected by said adjustment means whereby, pressure generated by fluid from said booster means at said regulated port closes said reducing means to flow therethrough from said single hydraulic source during operation of said reciprocating drive pistons.

8. A shear machine in accordance with claim 7, characterized by said booster means including a booster assembly comprising a housing with an included piston flow connected to said hold-down means, one end of said assembly supported by one of said side walls and the other by said ram and driven by said ram during movement of said ram toward said work.

9. A shear machine in accordance with claim 8, characterized by said booster assembly supplied fluid from said single hydraulic source means during movement of said ram away from said work.

10. A shear machine in accordance with claim 9, characterized by said hydraulic circuitry comprising a flow directing solenoid operated hold-down valve for timely control of fluid flow from said single source means to said hold-down means or to said booster means.

11. A shear machine in accordance with claim 7, characterized by said pressure reducing means including a relief port flow connected to a relief passageway for relieving fluid in excess of that needed to maintain said pressure selected at said regulated port thereby providing relief for excess fluid from said booster means while maintaining said selected pressure at said hold-down means.

* * * * *